US011642776B1

(12) United States Patent
Tschida et al.

(10) Patent No.: US 11,642,776 B1
(45) Date of Patent: May 9, 2023

(54) DISMANTLABLE PORTABLE SAWHORSE

(71) Applicants: Roger Tschida, Phoenix, AZ (US); Shane Tschida, Phoenix, AZ (US)

(72) Inventors: Roger Tschida, Phoenix, AZ (US); Shane Tschida, Phoenix, AZ (US)

( * ) Notice: Subject to any disclaimer, the term of this patent is extended or adjusted under 35 U.S.C. 154(b) by 0 days.

(21) Appl. No.: 17/849,559

(22) Filed: Jun. 24, 2022

Related U.S. Application Data

(63) Continuation of application No. 17/548,543, filed on Dec. 12, 2021, now Pat. No. 11,400,579.

(51) Int. Cl.
*B25H 1/06* (2006.01)

(52) U.S. Cl.
CPC ..... *B25H 1/06* (2013.01)

(58) Field of Classification Search
CPC ..... B25H 1/06; B25H 1/00; B25H 1/0078; B25H 1/04; B25H 1/08; B27B 21/00; B27B 5/06; B27B 17/0041; F16M 11/00; A47B 37/00; B23Q 9/0042; B23Q 9/0014
USPC ..... 182/151, 153, 155; 269/296, 901, 16, 269/134–138, 291
See application file for complete search history.

(56) References Cited

U.S. PATENT DOCUMENTS 1,597,555 A 1/1925 Tolmie
1,953,012 A 6/1932 Gerrard
2,501,656 A 5/1946 Anderson
3,042,144 A * 7/1962 Larson ..... A47B 13/021 182/186.3
3,289,789 A 12/1966 Larson
3,329,239 A 7/1967 Chesney
3,446,312 A * 5/1969 Jones ..... B25H 1/06 182/186.1
3,530,956 A 9/1970 Jadek
3,858,682 A 1/1975 Larson
4,192,406 A * 3/1980 Mitchell ..... B25H 1/06 182/186.3
4,890,952 A * 1/1990 Jones ..... B25H 1/06 403/217
4,911,390 A * 3/1990 Flick ..... A47B 3/12 182/186.3
5,678,655 A 10/1997 Bearden
5,779,003 A 7/1998 Carty
6,612,401 B1 9/2003 Price et al.
6,810,996 B2 11/2004 Rump
(Continued)

*Primary Examiner* — Joseph J Hail
*Assistant Examiner* — Timothy Brady
(74) *Attorney, Agent, or Firm* — Invention To Patent Services; Alex Hobson

(57) ABSTRACT

A dismantlable portable sawhorse utilizes a bracket plate having a plank aperture and a support aperture that have lengths that are substantially orthogonal to each other and intersect to form a continuous aperture having an intersection space. The plank and support apertures are configured to receive various arrangements of plank lumber and support lumber, respectively. The bracket plate also has a front and back leg cup configured to receive leg lumber therein to lift the bracket plates up from the ground. The sawhorse is formed with two bracket plates configured with at least one of support and plank lumber configured in the respective apertures and extending between the two bracket plates and with leg lumber configured in each of the front and back leg cups of each bracket plate. The bracket plates may lean inward toward each other at a stand angle.

16 Claims, 14 Drawing Sheets

(56) References Cited

U.S. PATENT DOCUMENTS

| | | | | |
|---|---|---|---|---|
| 7,021,424 | B2 * | 4/2006 | Herman | B25H 1/06 248/440 |
| 8,151,939 | B2 * | 4/2012 | Osborne | B25H 1/06 182/186.3 |
| 8,708,103 | B2 | 4/2014 | Bulley | |
| 8,807,498 | B1 | 8/2014 | McCoy et al. | |
| 2003/0213648 | A1 * | 11/2003 | Dembicks | B25H 1/06 182/185.1 |
| 2010/0012432 | A1 | 1/2010 | Noel | |
| 2012/0312202 | A1 | 12/2012 | Burnett | |

* cited by examiner

DISMANTLABLE PORTABLE SAWHORSE

CROSS REFERENCE TO RELATED APPLICATIONS

The application is a continuation of U.S. patent application Ser. No. 17/548,543, filed on Dec. 12, 2021 and currently pending; the entirety of which is hereby incorporated by reference herein.

BACKGROUND OF THE INVENTION

Field of the Invention

The invention relates to portable sawhorses that can be dismantled and in particular use lumber for supports with a sawhorse bracket assembly.

Background

Sawhorses are routinely used on construction job sites to support items for cutting, painting, sanding, assembly and the like. There are foldable sawhorses but the top support extension and legs are long and the folded sawhorse takes up a lot of room for storage and transport. Also, these foldable sawhorses are typically short and one size. It is desirably in some cases to have much longer sawhorses to support large planks of wood or plywood, for example.

SUMMARY OF THE INVENTION

The invention is directed to a dismantlable sawhorse and a method of assembling said dismantlable sawhorse. The dismantlable sawhorse is formed from a sawhorse bracket assembly having two sawhorse brackets each having a bracket plate with a front and back leg cup to coupled thereto to receive leg lumber therein to lift the bracket plates up from the ground. Each bracket plate also has a plank aperture and a support aperture that intersect to form a continuous aperture through the bracket plates. The plank aperture is wider than the support aperture to receive a plank of lumber that extends from the first bracket plate to the second bracket plate with the larger cross-sectional dimension, or width, extending in the width direction. The support aperture has a height that is at least twice the width to receive a support lumber that has a high moment of inertia to provide adequate support for heavy loads placed on the sawhorse. The support aperture has the width or larger cross-sectional dimension extending in the vertical axis. The moment of inertia for a rectangular beam is $lx=\frac{1}{12}\ b\ h3$, the resistance to vertical deflection is much higher when the long axis, or width of the lumber is in the vertical or ($h^3$) axis.

The plank aperture and the support apertures may form a T-aperture having a "T" shape with the plank aperture extending over the support aperture or a cross-aperture, having a "cross" shape, wherein the plank aperture extends through the support aperture. The T-aperture may be configured with the plank aperture centered over the support aperture. The cross-aperture may be configured with the plank aperture centrally located along the height of the support aperture and centrally located with respect to width, to create a symmetric cross-aperture.

The bracket plate may be made out of a rigid planar material, such as plywood, or metal and has a thickness of about 5 mm or more, 10 mm or more, 15 mm or more, 20 mm or more, 25 mm or more and any range between and including the thickness values provided. The bracket plates have a height from the bottom to the top and may taper in width from the bottom to the top. The height of the bracket plates may be about 30 cm or more, about 40 cm or more, about 50 cm or more, about 60 cm or more, about 75 cm or more and any range between and including the height values provided. Likewise, the bracket plate may have a width of about 30 cm or more, about 40 cm or more, about 50 cm or more, about 60 cm or more, about 75 cm and any range between and including the width values provided. The plank and support apertures may be configured more proximal to the top of the bracket plates than the front and back leg cups.

The front leg cup and the back leg cup are configured on either of the front and back side of the bracket plate and have a leg cup opening along the bottom of the leg cup to receive leg cup lumber. The leg cup channel has a depth from the bottom or leg cup opening to the top of the leg cup channel that is effectively deep enough to retain the leg lumber therein. The depth may be about 75 mm or more, about 100 mm or more, about 125 mm or more, about 150 mm or more, about 200 mm or more and any range between and including the depths provided. The leg cup channel may have a height and width that is configured to receive conventional lumber, such as a 2×4, or a 2×6. The dimensions of height and width may be substantially, 1.5 inch thick×3.5 inch wide, (38.1 mm×88.9), or 1.5 inch thick×5.5 inch wide, (38.1 mm×139.7 mm). Substantially, as used herein with respect to the aperture dimensions, means the listed dimension or about 0.25 inch larger to enable the lumber to slide into the leg cup channel. The leg cup channel may also taper in dimension from the leg cup opening up along the leg cup channel to pinch and retain the leg lumber therein. The leg cup channels may extend in a leg angle from vertical or the height axis of the bracket plate, which may be about 20 degrees or more, about 30 degrees or more, about 45 degrees or more, about 55 degrees or more and any range between and including the stand angles provided. Note that the length of the leg lumber may be selected to change the height of the sawhorse.

The plank aperture and support aperture are coupled together in a contiguous aperture, versus discrete apertures through the sawhorse bracket. The plank and support apertures may be configured as a T-aperture or a cross-aperture with the plank aperture extend over or through the support aperture, respectively. The cross-over of the two apertures forms an intersection space that may be conducive to retain circular items or rod supports as described herein. The plank aperture has a width and height configured to receive plank lumber. The width of the plank aperture is greater than the width of the support aperture and may be at least twice as wide. The height of the support aperture is greater than the width of the support aperture and may be twice as larger or more. Both the plank aperture and the support aperture may be configured to receive lumber with conventional dimensions, such as 2×4 or a 2×6, with dimensions of, 1.5 inch thick×3.5 inch wide, (38.1 mm×88.9 mm), and 1.5 inch thick×5.5 inch wide, (38.1 mm×139.7 mm), respectively. The plank and support apertures may have substantially these dimensions and are preferably a little larger such as 10% or 20% larger to allow easy insertion and manipulation of the lumber therethrough.

A circular aperture may be configured through the bracket plate to receive and retain a rod support, which may be a rod or pipe having a diameter that fits through the circular aperture. The rod support may be a hollow pipe or a solid rod such as rebar.

Each of the plank aperture, support aperture and circular aperture may have teeth along the inside edge of the aperture to bite into and secure the lumber in a fixed position and to prevent the lumber from sliding while work is being performed on the sawhorse. The teeth may be small serrations, sawtooth shaped or, polygonal in shape, such as raised squares or rectangles with a height of about 5 mm or less, 3 mm or less of from about 2 mm to about 5 mm. The plank aperture teeth and support aperture teeth may be different in shape and size than the circular aperture teeth. The teeth in the T-aperture or cross-apertures may provide increased pressure on wood configured therein by providing a reduced surface area of the aperture in contact with the wood.

The portable sawhorse is configured with two sawhorse stands configured with at least one of plank lumber, support lumber and/or a rod support extending therebetween. The sawhorse stands may lean inward toward each other a stand angle with respect to a vertical axis. This offset angle pinches the plank and/or support lumber in the apertures to retain them therein. The offset angle may be about 10 degrees or more, about 15 degrees or more, about 25 degrees or more, about 30 degrees or more and any range between and including the stand angles provided.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
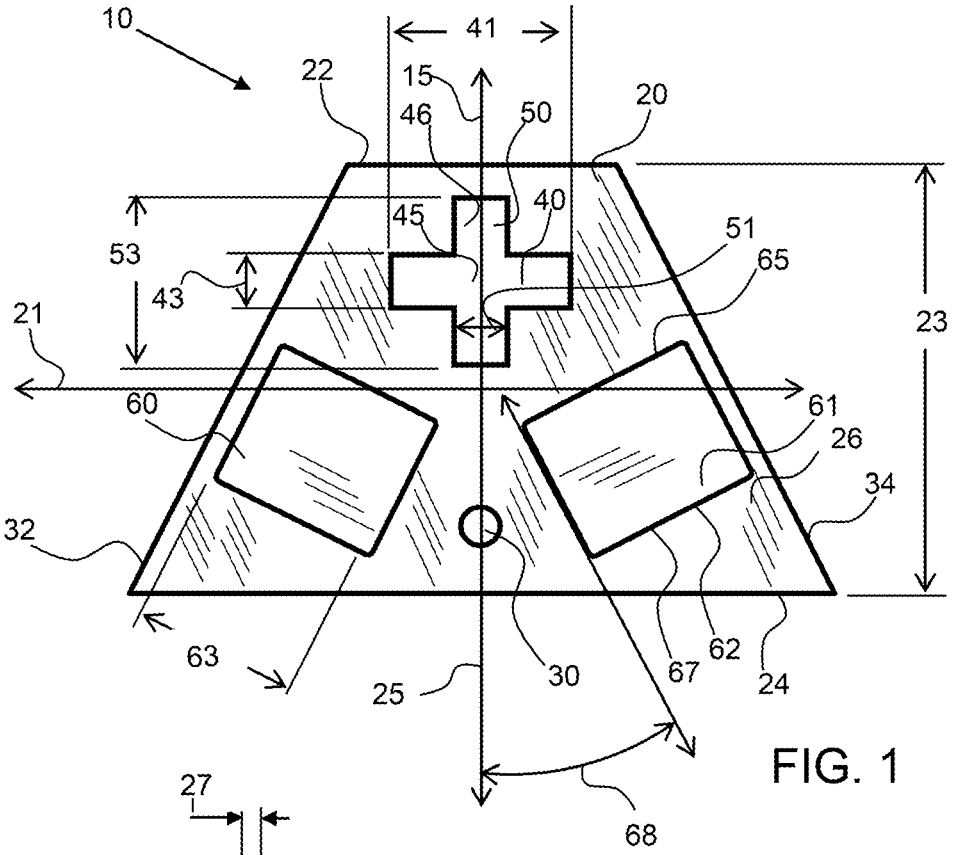
FIG. 1 shows an outside view of an exemplary saw horse bracket of a sawhorse bracket assembly.
Figure 2:
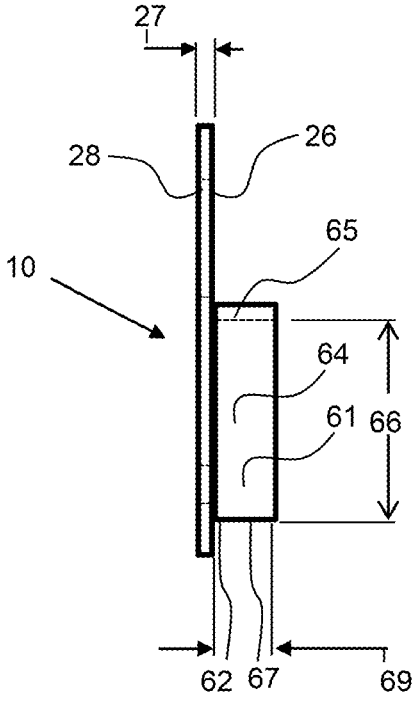
FIG. 2 shows a side view of an exemplary saw horse bracket of a sawhorse bracket assembly.
Figure 3:
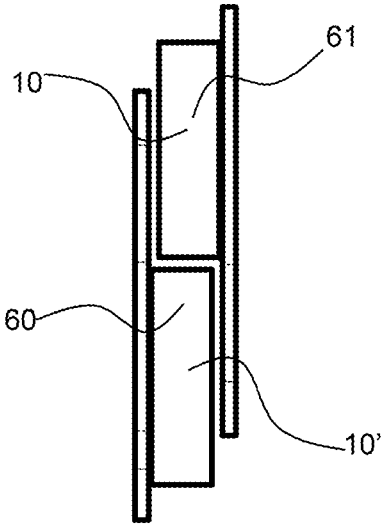
FIG. 3 shows side view of a pair of saw horse brackets stacked for transport of storage.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Referring now to FIGS. 1-16, a sawhorse 12 is formed by a pair of sawhorse bracket assemblies 11, 11', that create sawhorse stands 14, 14'. The sawhorse stands secure plank lumber 81, and/or support lumber 82, and/or a rod support 90 to produce said sawhorse. A sawhorse bracket assembly includes a sawhorse bracket 10, having a bracket plate 20 with a front leg cup 60 and a back leg cup 61 for receiving leg lumber 80, 80' to support the bracket plates up from the ground. The bracket plate also has a plank aperture 40 and a support aperture 50 configured to receive lumber therein to produce sawhorse stands 14, 14', and a sawhorse 12 with the support lumber 82 and/or plank lumber 81 extending therebetween. As shown in FIGS. 1 to 8 the plank aperture 40 and support aperture 50 form a cross-aperture 46 and in FIGS. 9 to 16, the plank aperture and support apertures form a T-aperture 44, each having an intersection space 45. Each of the T-aperture and cross-apertures are continuous apertures 48 having an opening with a continuous perimeter about said opening. This configuration of intersecting plank and support aperture enables a wide variety of configurations to suit a particular application. A single piece of plank lumber or support lumber may be inserted into their respective aperture, or both may be inserted. Also, a rod support 90 may be inserted into the T-aperture or cross-aperture and may be inserted into the intersection space. The plank and support apertures may be slightly oversized to enable lumber to be easily inserted therein. A circular aperture 30 is configured in the bracket plate to receive and retain a pipe or rebar, for example.

The width of the bracket plate 20 tapers along the height axis 25, from the bottom 24 to the top 22. The bracket has a width axis 21 and a height 23. The front and back leg cups extend from the outside surface 26 of the bracket plate and the bracket plate has a thickness 27 that is effective rigid for supporting the sawhorse 12 with a load configured thereon. The inside surface 28 of the bracket plate may be configured to face the opposing bracket plate when the sawhorse stand is assembled, as shown in FIGS. 5, 7, 13, 15 and 16.

Figure 4:
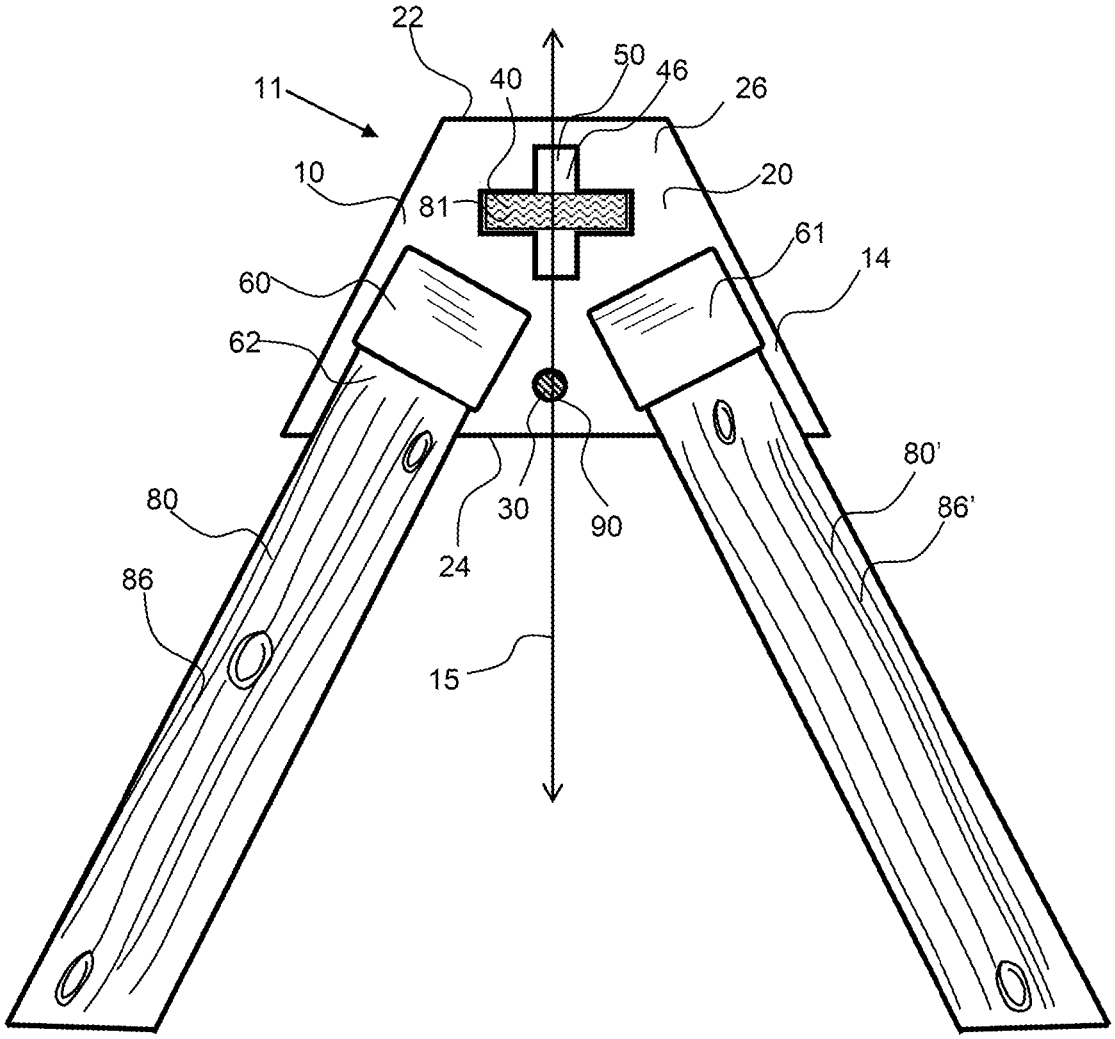
FIG. 4 shows an outside view of a sawhorse bracket assembly having leg lumber configured in the leg cups and plank lumber configured in the plank aperture.
Figure 12:
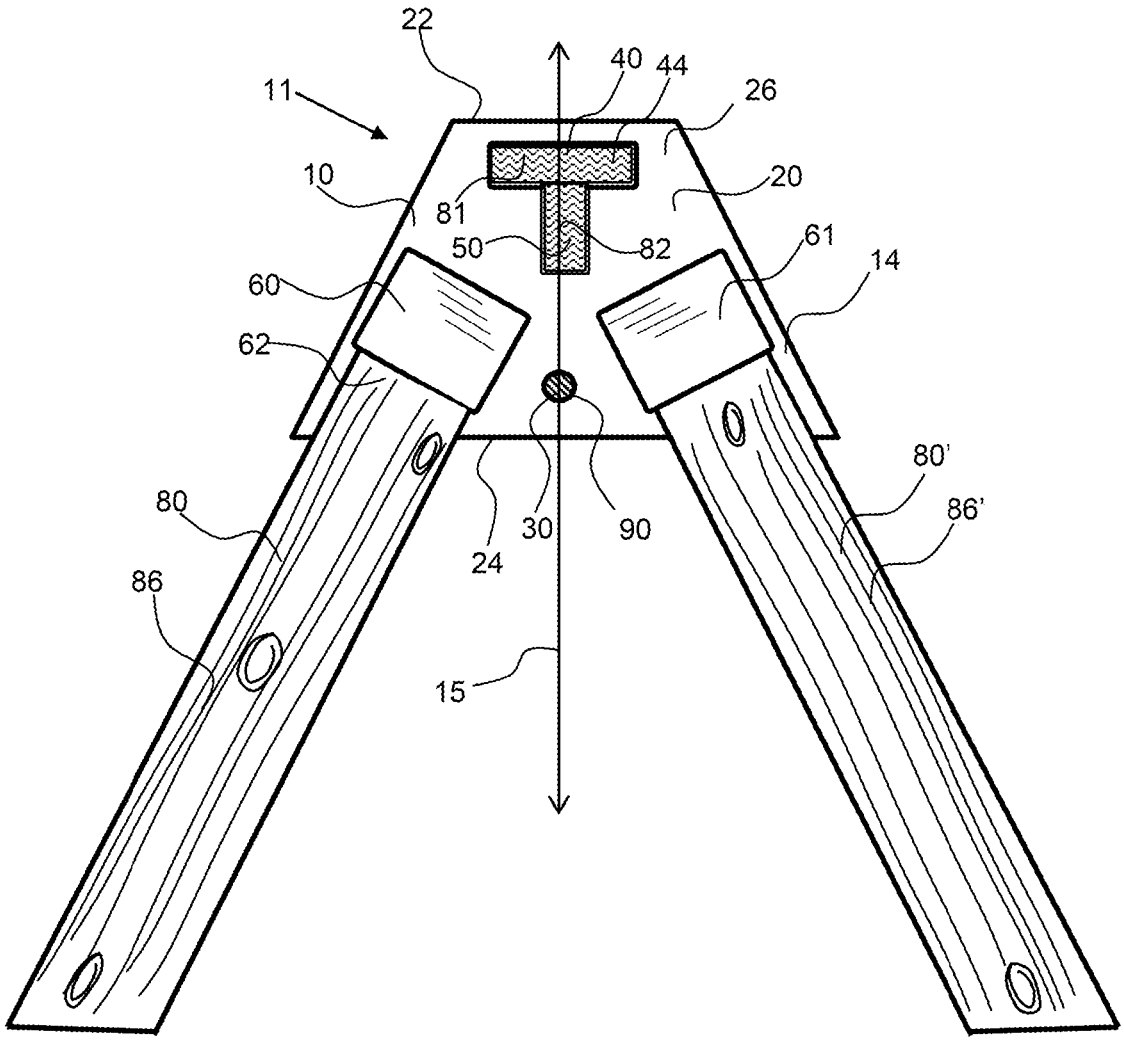
FIG. 12 shows an outside view of a sawhorse bracket assembly having leg lumber configured in the leg cups and plank lumber configured in the plank aperture.

The cup apertures are configured at a leg angle 68 from the height axis 25 of the bracket plate 20, which may align with a vertical axis 15 when the sawhorse stand 14 is erected, as shown in FIGS. 4 and 12. The leg angle may substantially align with the front or back sides of the bracket plate, such as within about 15 degrees, within about 10 degrees, within about 5 degrees, or any range between and including the values provided. Each of the leg cup apertures have a leg cup opening 62 for the insertion of leg lumber therein. The depth 66 of the leg cup channel 64 may be effectively long from the top 65 to the bottom 67 or leg cup opening 62, to retain the leg lumber therein. The width 63 and height 69 of the leg cup channel may be configured to receive leg lumber, as shown in FIGS. 4-8 and 12-16, with conventional dimensions, such as 1.5 inch thick×3.5 inch, wide (38.1 mm×88.9 mm), or 1.5 inch thick×5.5 inch wide, (38.1 mm×139.7 mm).

The plank aperture has a plank width 41 and plank height 43 configured to receive plank lumber, that extends orthogonally to the height axis 25 of the bracket plate 20. The width of the plank aperture is greater than the support width 51 of the support aperture 50 and may be at least twice as wide. The support aperture height, or support height 53, extends along the height axis 25 of the bracket plate and the support width 51 of the support aperture extends orthogonally from the height axis.

As shown in FIGS. 1-8, a cross-aperture is configured through the bracket plate with the support aperture 50 extending across the plank aperture 40, whereby a portion of the support aperture is above and below the plank aperture with respect to the height axis of the bracket plate. The plank aperture may be centered along the width of the bracket plate and also centered along the support aperture. Also, the plank aperture may be centered along the height of the support aperture, forming a symmetric cross-aperture of the plank and support apertures.

As shown in FIGS. 9 to 16, a T-aperture is configured through the bracket plate with the plank aperture configured at the end of the support aperture, and as shown, at the top of the support aperture. The plank aperture may be centered along the width of the bracket plate and also centered over the support aperture, thereby forming a symmetric T-aperture of the plank and support apertures.

Figure 9:
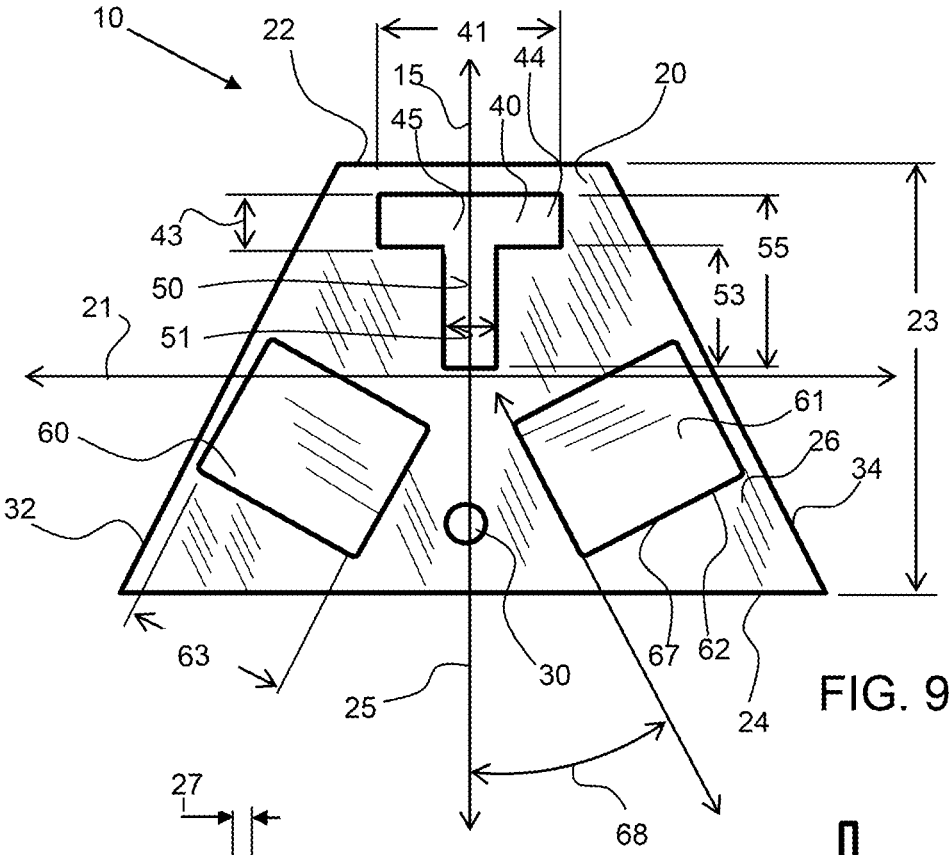
FIG. 9 shows an outside view of an exemplary saw horse bracket of a sawhorse bracket assembly.
Figure 10:
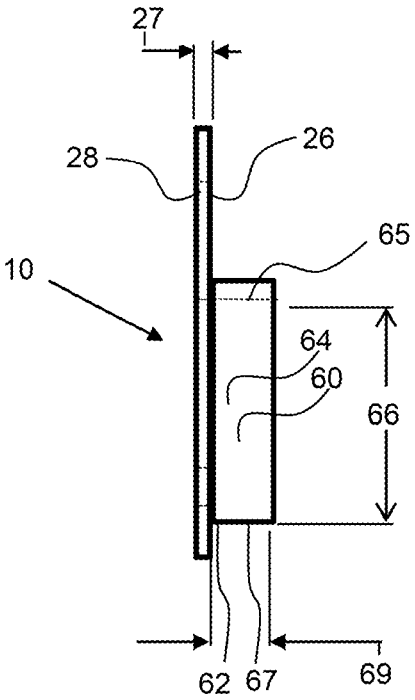
FIG. 10 shows a side view of an exemplary saw horse bracket shown in FIG. 9.
Figure 11:
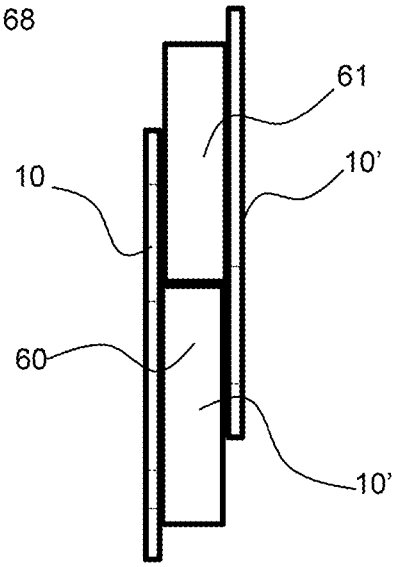
FIG. 11 shows side view of a pair of saw horse brackets stacked for transport of storage.

The height and width of the cross-aperture and T-aperture may be configured to receive support lumber with conventional dimensions, such as 1.5 inch thick×3.5 inch wide, (38.1 mm×88.9 mm), or 1.5 inch thick×5.5 inch wide, (38.1 mm×139.7 mm). The combined height 55 of the support aperture up to the top of the plank aperture, as shown in FIG. 9 may be configured to receive support lumber with conventional dimensions, such as 1.5 inch thick×5.5 inch wide, (38.1 mm×139.7 mm). The dimensions of the plank and support apertures may be oversized to allow easy insertion and manipulation of the lumber therethrough.

A circular aperture 30 is configured to receive and retain a rod support 90, which may be a rod or pipe having a diameter that fits through the circular aperture. The rod support may be a hollow pipe or a solid rod such as rebar.

Figure 17:
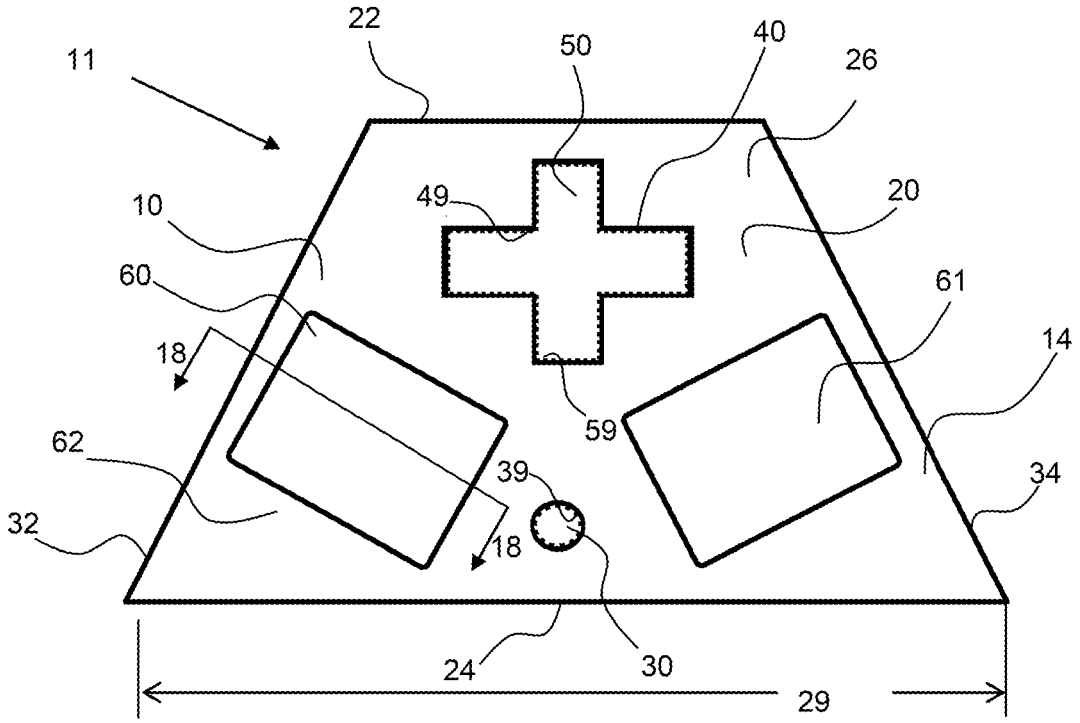
FIG. 17 shows an enlarged outside view of a sawhorse bracket having a cross-aperture and teeth configured along the aperture to more effectively retain the lumber therein.
Figure 18:
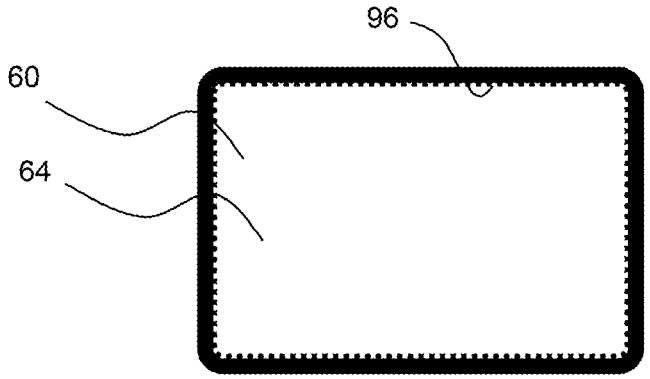
FIG. 18 shows a cross-sectional view along line 18-18 of FIG. 17 through the front leg cup, wherein cup-teeth are configured within the cup to more effectively retain the leg lumber therein.

With reference to FIGS. 17 and 18, each of the plank aperture 40, support aperture 50 and circular aperture 30 may have teeth along the inside edge of the aperture to bite into and secure the lumber and/or rod support in a fixed position and to prevent the lumber from sliding while work is being performed on the sawhorse. The teeth may be small serrations, sawtooth shaped or, polygonal in shape, such as raised squares or rectangles with a height of about 5 mm or less, 3 mm or less of from about 2 mm to about 5 mm. The plank aperture teeth 49 and support aperture teeth 59 may be different in shape and size than the circular aperture teeth 39. The teeth in the T-aperture or cross-apertures may provide increased pressure on wood configured therein by providing a reduced surface area of the aperture in contact with the wood. The width 29 of the bracket plate 20 across the bottom 24 from the front side 32 to the back side 34 is shown. As shown in FIG. 18, the front leg cup 60 has leg cup teeth 96 extending into the interior of the leg cup from the inside or interior wall or from the leg cup channel 64.

Figure 5:
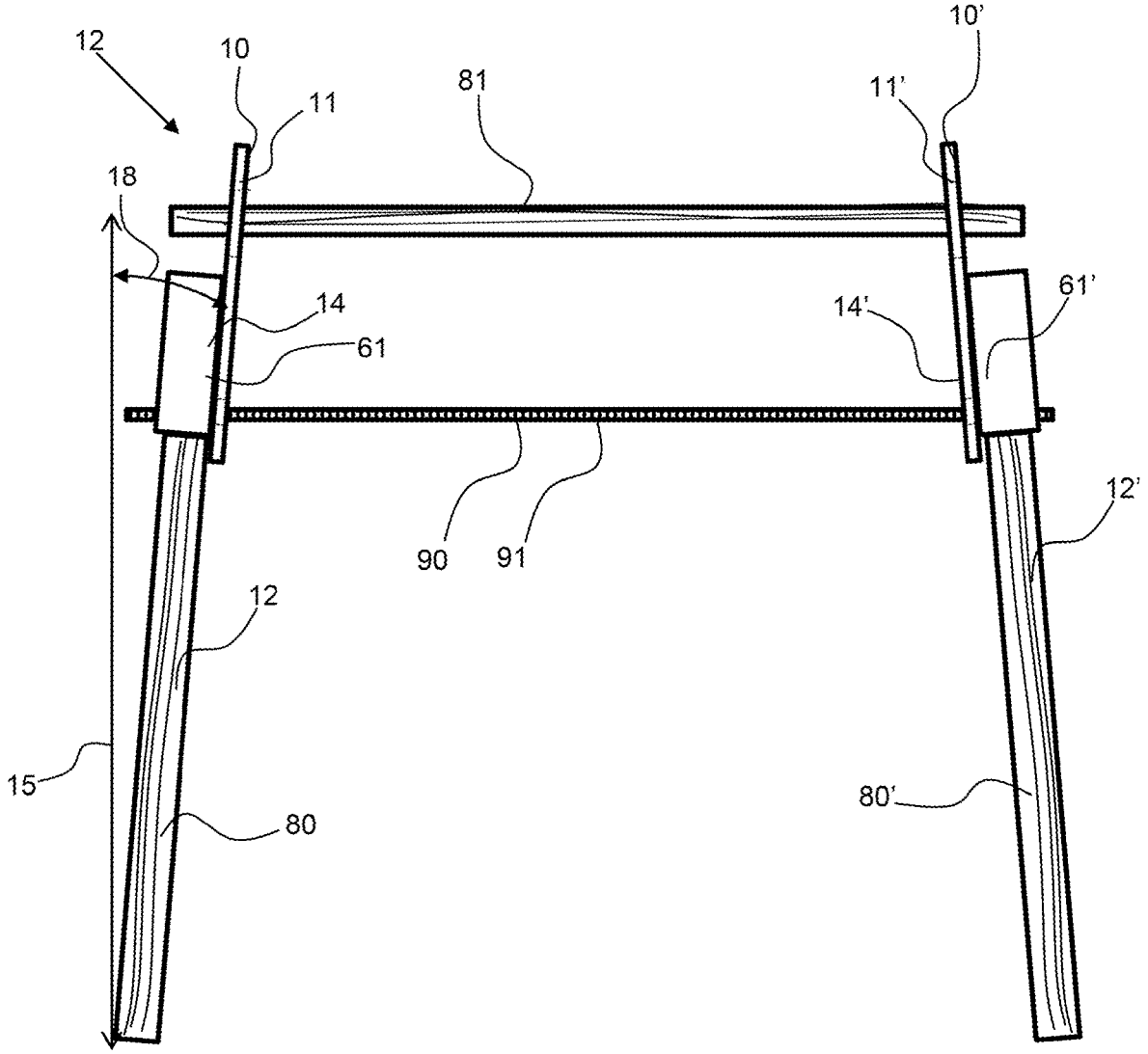
FIG. 5 shows a side view of a sawhorse formed by the sawhorse bracket assembly shown in FIG. 4 having leg lumber configured in each of the leg cups of the pair of saw horse brackets, plank lumber configured in and extending between the plank apertures and a rod support configured in and extending between the circular apertures.

As shown in FIG. 5, the sawhorse stands 14, 14' are angled toward each other a stand angle 18 from the vertical axis 15. This stand angle of the plane of the bracket plate 20 from vertical pinches the extensions, plank lumber, support lumber and/or support rod, extending between the two sawhorse bracket stands. As shown in FIGS. 4 and 5, the sawhorse 12 is assembled with the two sawhorse stands erected by the leg lumber 80, 80' inserted into the back leg cups. The bracket plate 20 is configured with a cross-aperture 46. A piece of plank lumber 81 is inserted into the plank aperture 40 of each of the sawhorse brackets 10, 10'. The plank lumber is configured with the width extending in the width axis of the bracket plate 20 and the thickness in the vertical axis of the bracket plate. A rod support 90, rebar 91, is configured through the circular aperture 30.

Figure 6:
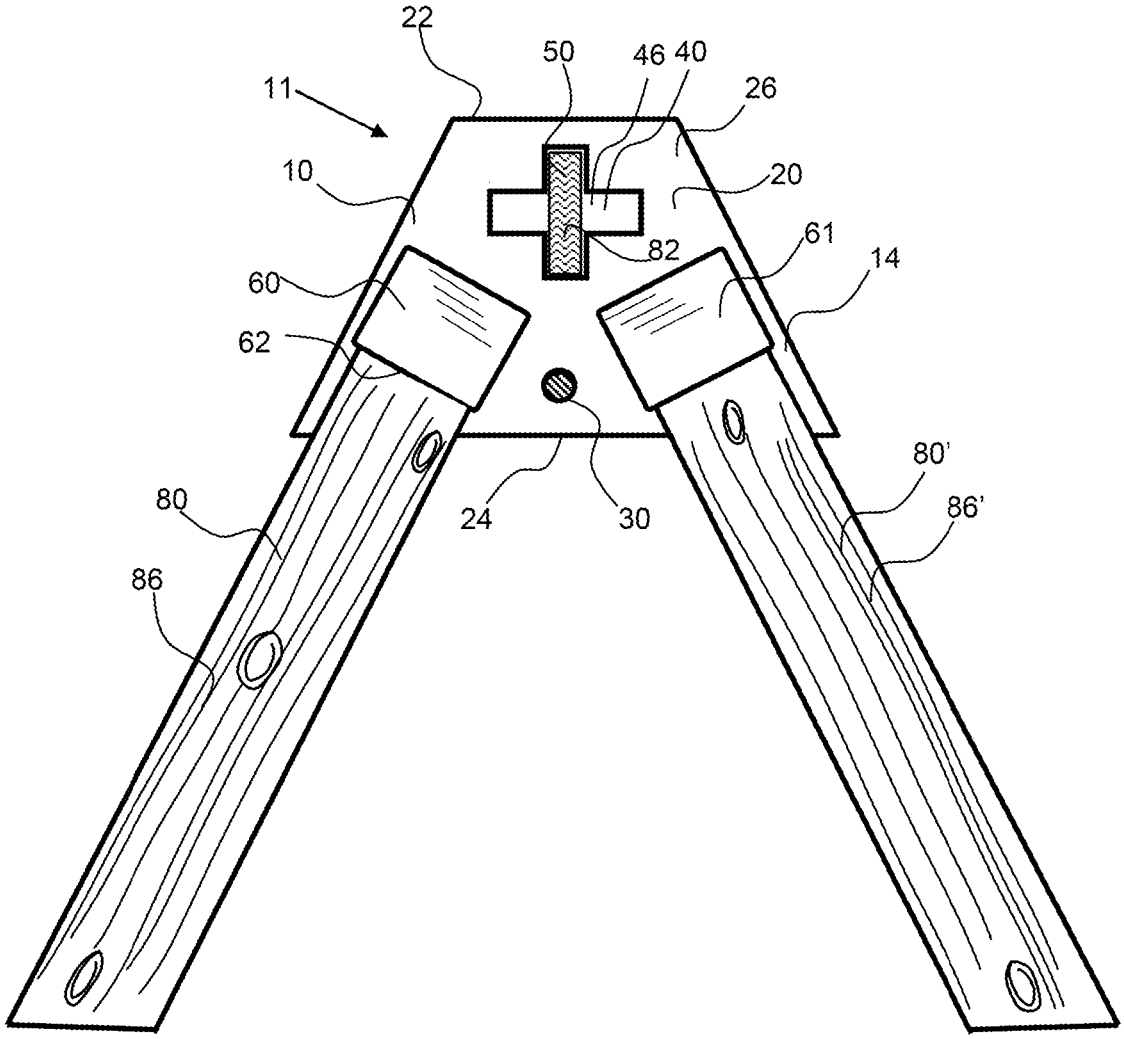
FIG. 6 shows an outside view of a sawhorse bracket assembly having leg lumber configured in the leg cups and support lumber configured in the support aperture.
Figure 7:
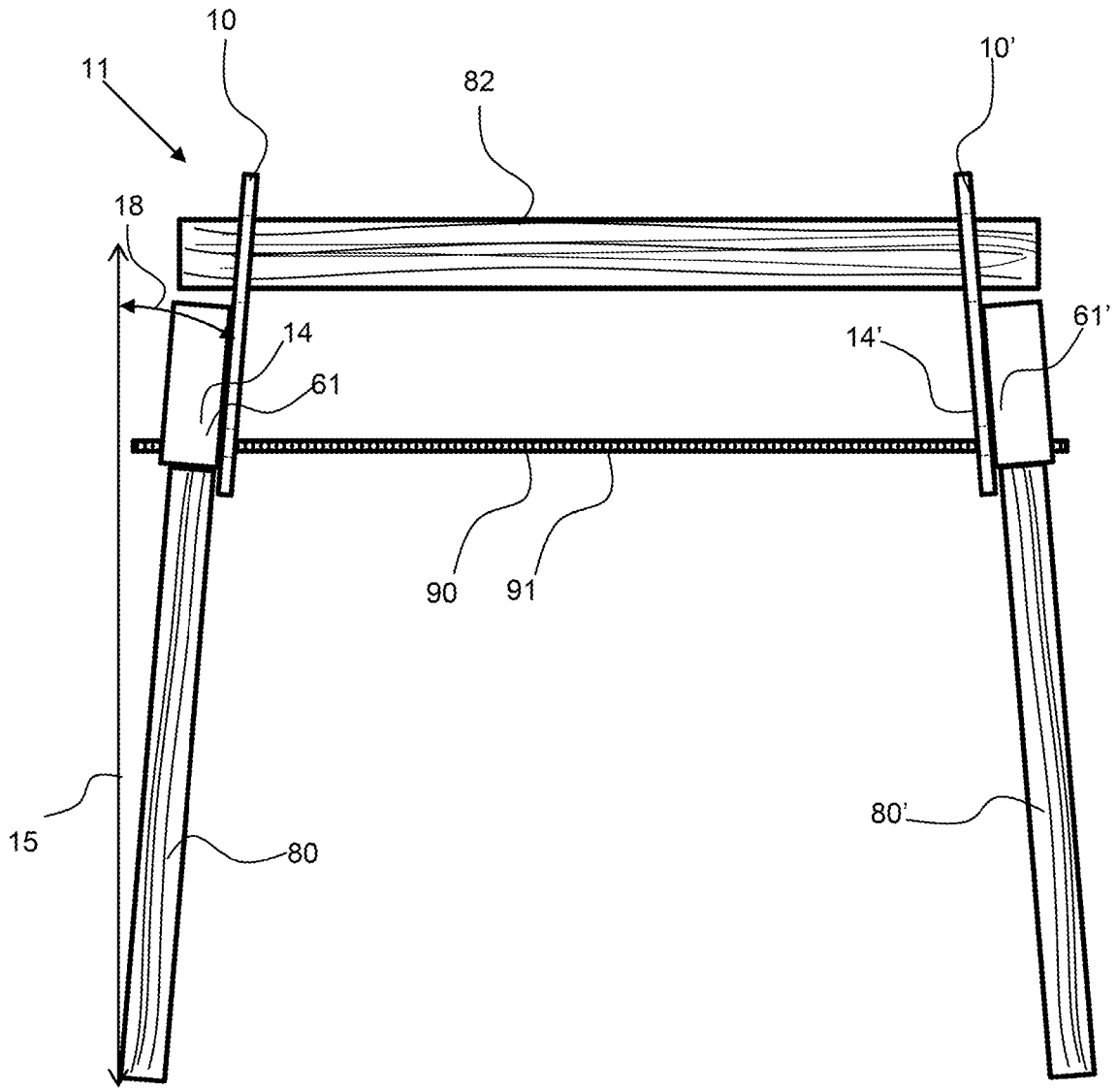
FIG. 7 shows a side view of a sawhorse formed by the sawhorse bracket assembly shown in FIG. 6 having leg lumber configured in each of the leg cups of the pair of saw horse brackets, support lumber configured in and extending between the support apertures and a rod support configured in and extending between the circular apertures.

As shown in FIGS. 6 and 7, a support lumber 82 is configured in the support aperture 50. The bracket plate 20 is configured with a cross-aperture 46. The support lumber is configured with the width extending in the vertical axis of the bracket plate 20 and the thickness in the width axis of the bracket plate. As described herein, this configuration produces higher support and resistance to bending as the moment of inertia in the vertical direction is much higher than when the width of the lumber extends in the width direction; such as with plank lumber. As the moment of inertia for a rectangular beam is $Ix=\frac{1}{12}\ b\ h3$, the resistance to vertical deflection is much higher when the long axis, or width of the lumber is in the vertical or ($h^3$) axis.

Figure 8:
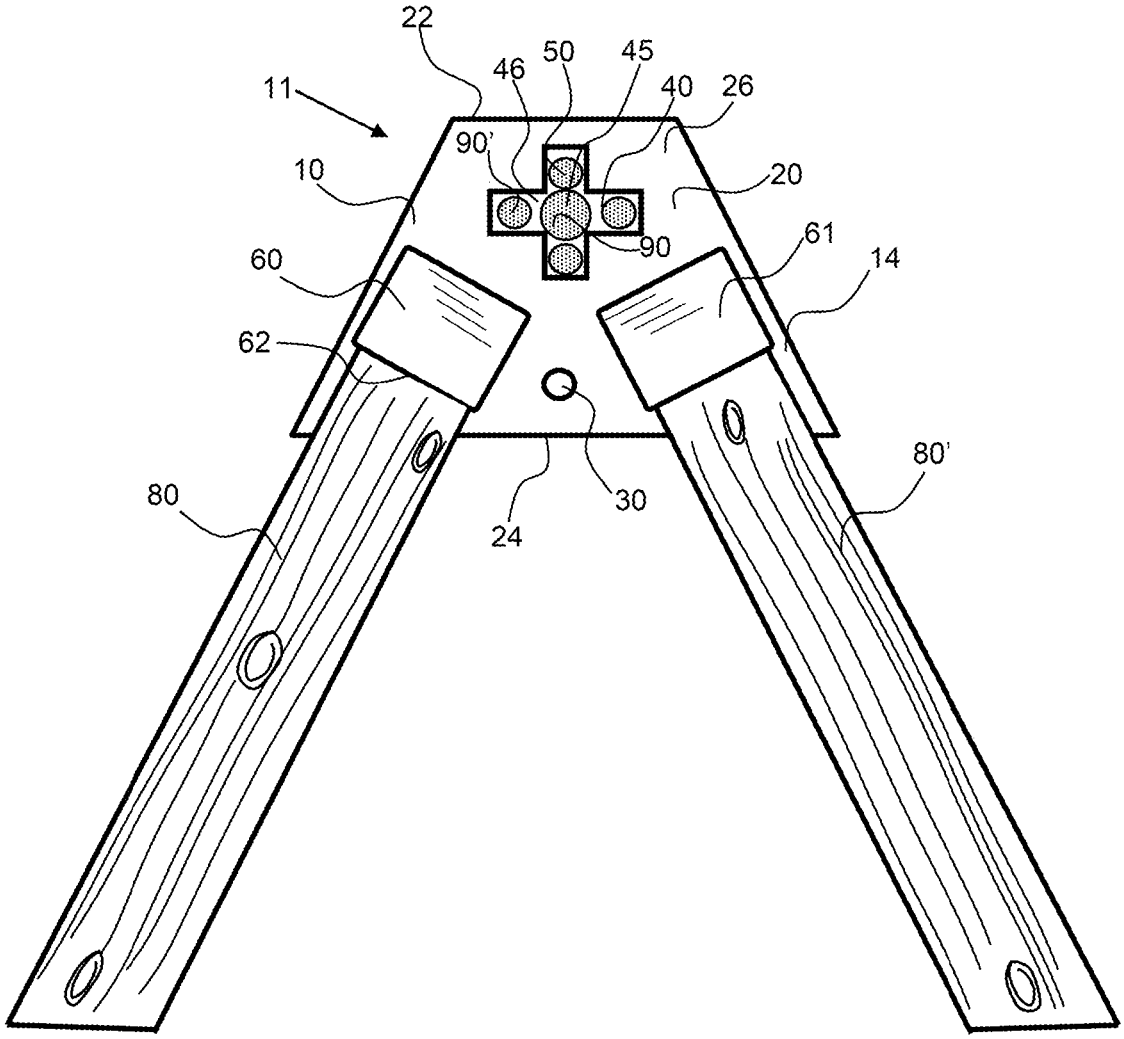
FIG. 8 shows an outside view of a sawhorse bracket assembly having leg lumber configured in the leg cups and a plurality of rod supports configured in the cross-aperture.

As shown in FIG. 8, a bracket plate 20 has a cross-aperture 46 and a plurality of rod supports 90, 90' inserted therethrough, including in the intersection space 45.

Figure 13:
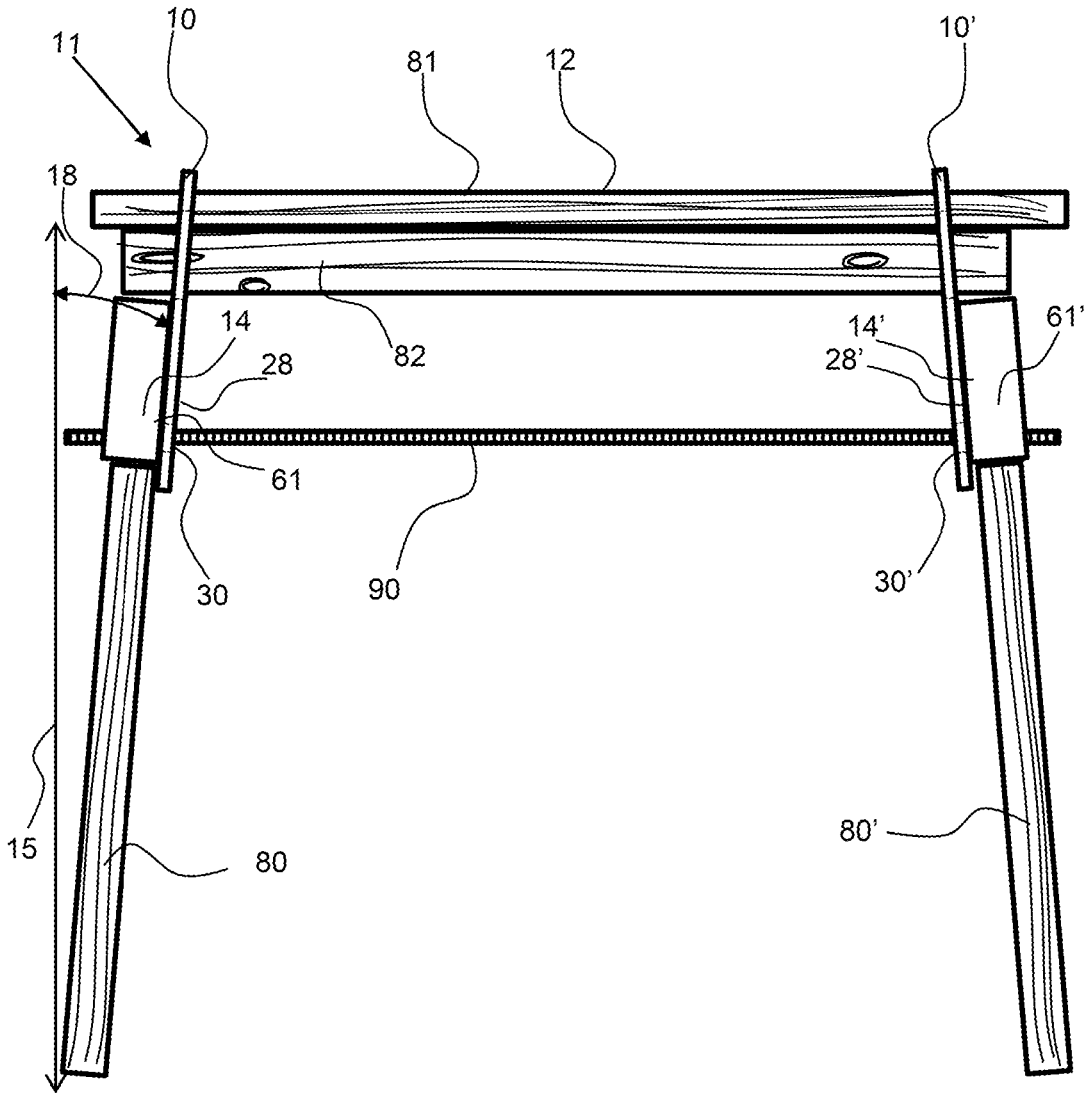
FIG. 13 shows a side view of a sawhorse formed by the sawhorse bracket assembly shown in FIG. 12 having leg lumber configured in each of the leg cups of the pair of saw horse brackets, plank lumber configured in and extending between the plank apertures and a rod support configured in and extending between the circular apertures.
Figure 16:
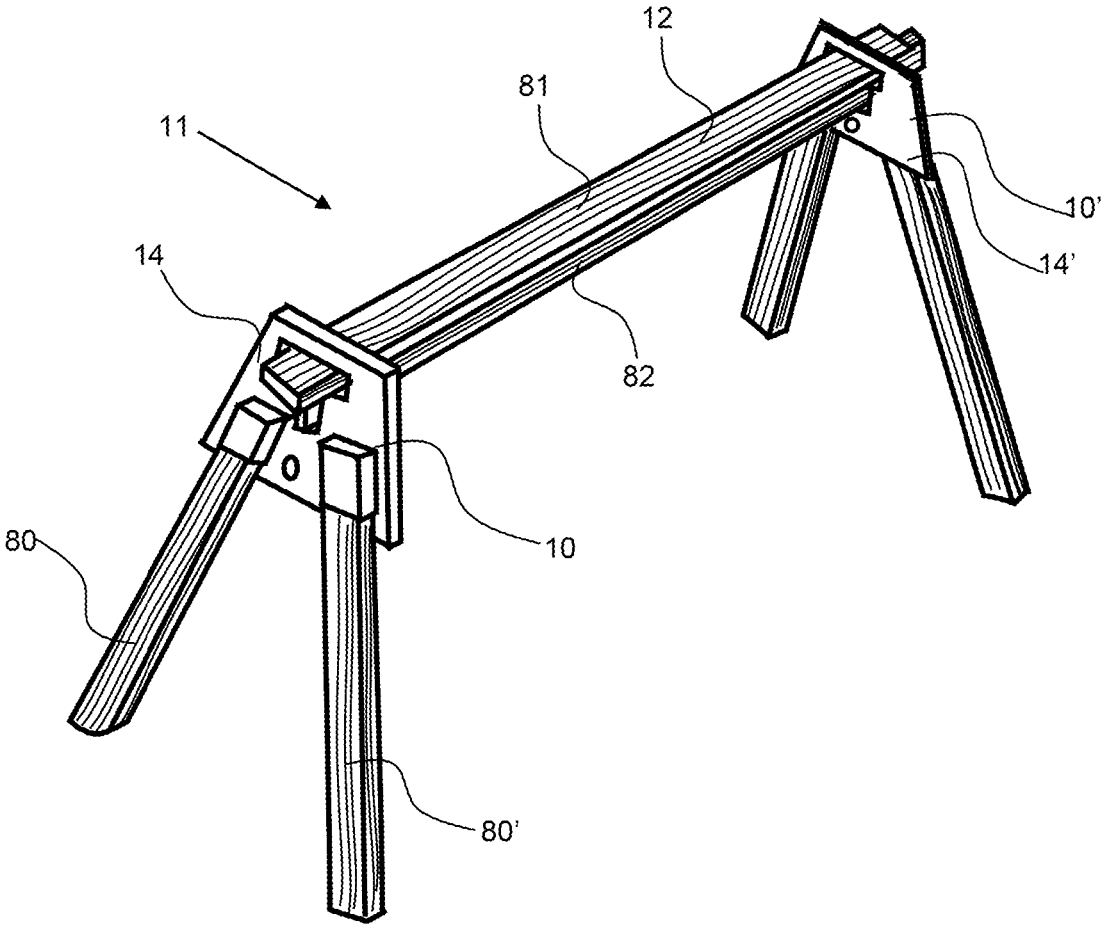
FIG. 16 shows a perspective view of a sawhorse formed by the sawhorse bracket assembly shown in FIG. 12 having leg lumber configured in each of the leg cups of the pair of saw horse brackets, support lumber configured in and extending between the support apertures and plank lumber configured in and extending between the plank apertures.

As shown in FIGS. 12, 13 and 16, the sawhorse 12 is assembled with the two sawhorse stands erected by the leg lumber 80, 80' inserted into the back leg cups. The bracket plate 20 is configured with a T-aperture 44. A piece of plank lumber 81 is inserted into the plank aperture 40 of each of the sawhorse brackets 10, 10'. A piece of support lumber 82 is inserted into the support aperture 50 of each of the sawhorse brackets 10, 10' and is configured under the plank lumber. The support lumber supports the plank lumber as it has a higher stiffness in the vertical axis 15. The plank lumber is configured with the width extending in the width axis of the bracket plate 20 and the thickness in the vertical axis of the bracket plate. The support lumber is configured with the width extending in the vertical axis of the bracket plate 20 and the thickness in the width axis of the bracket plate.

Figure 14:
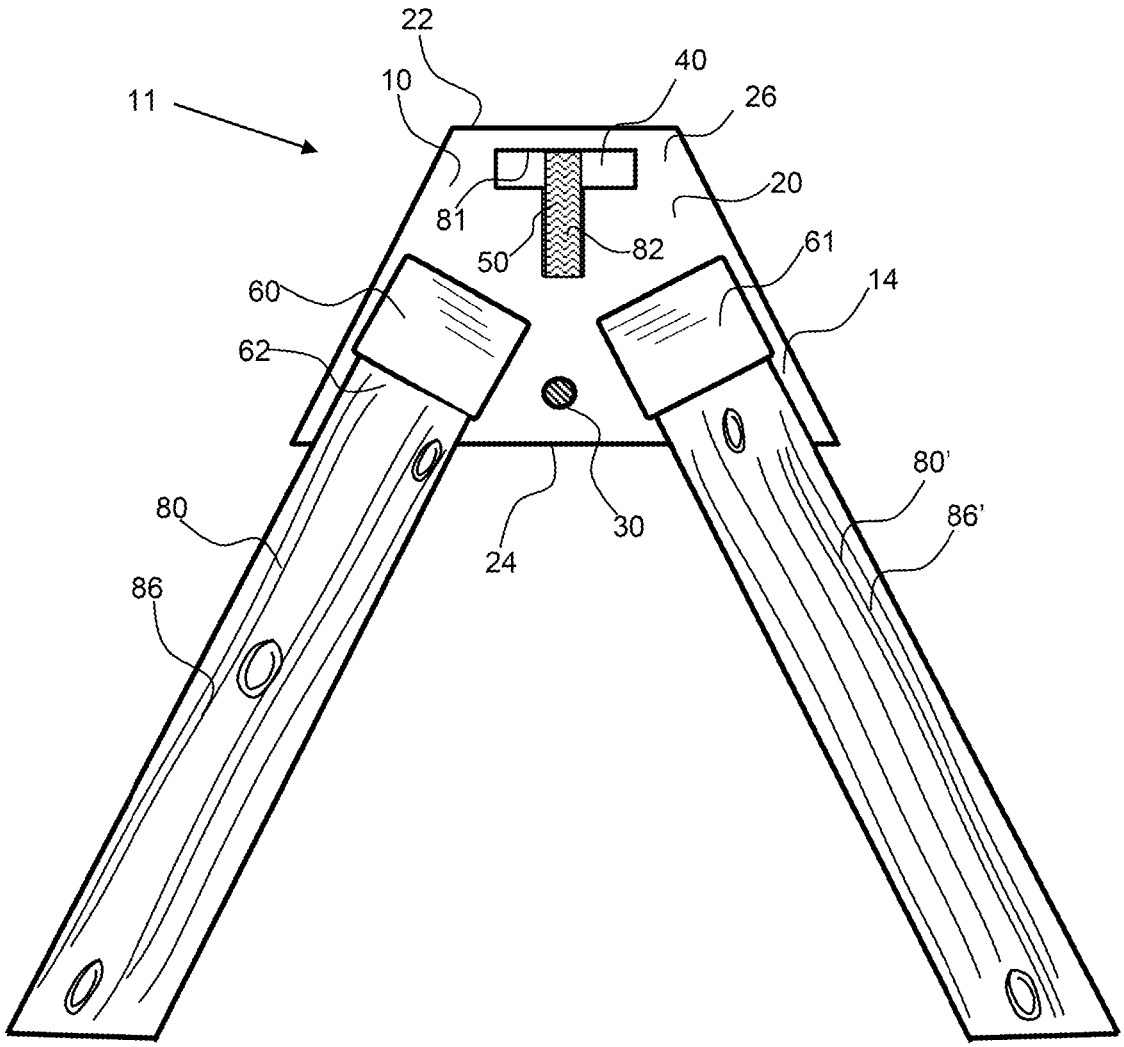
FIG. 14 shows an outside view of a sawhorse bracket assembly having leg lumber configured in the leg cups and support lumber configured in the support aperture.
Figure 15:
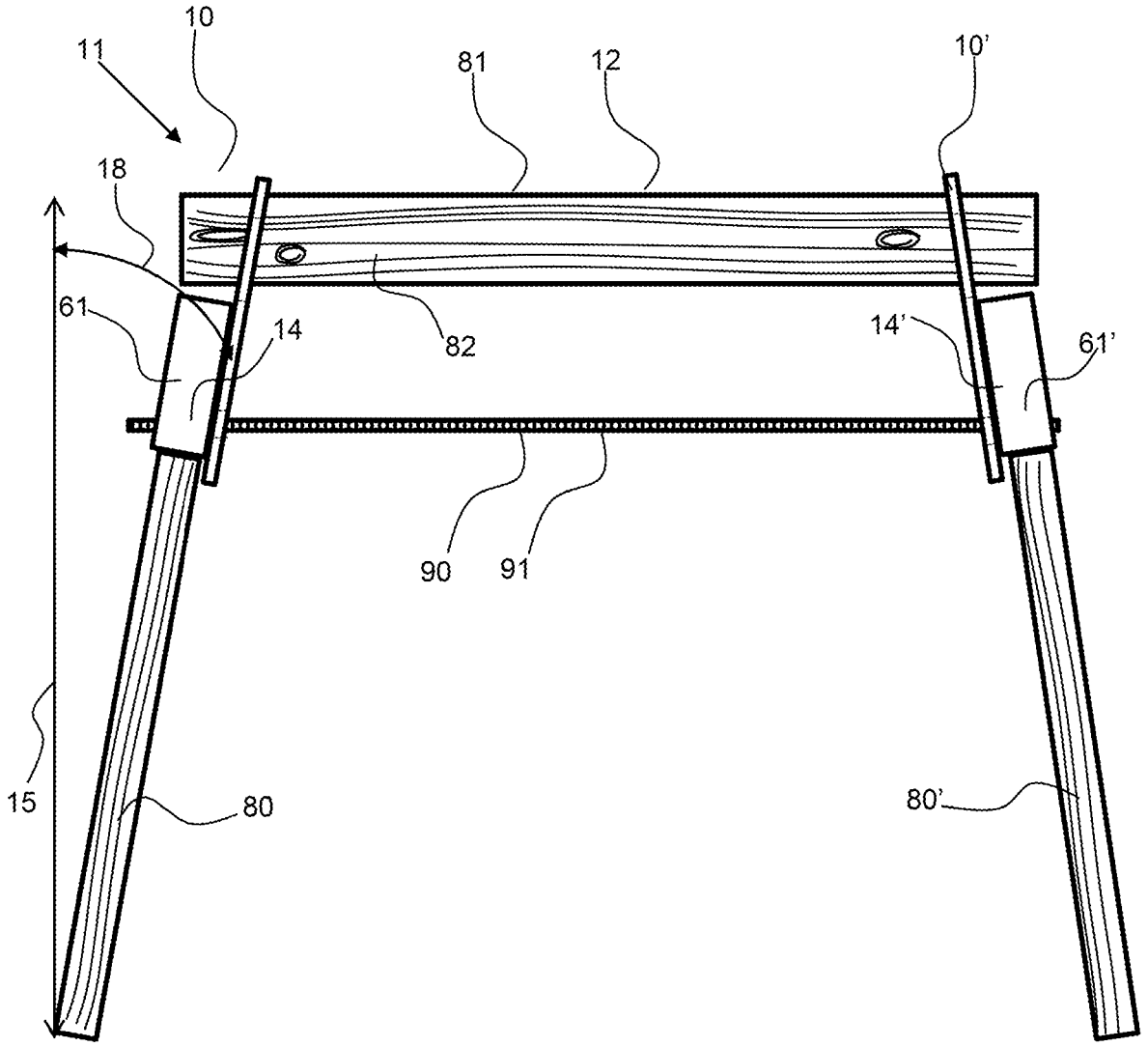
FIG. 15 shows a side view of a sawhorse formed by the sawhorse bracket assembly shown in FIG. 14 having leg lumber configured in each of the leg cups of the pair of saw horse brackets, support lumber configured in and extending between the support apertures and a rod support configured in and extending between the circular apertures.

As shown in FIGS. 14 and 15, a support lumber 82 is configured in the support aperture 50. The support lumber is configured with the width extending in the vertical axis of the bracket plate 20 and the thickness in the width axis of the bracket plate. As described herein, this configuration produces higher support and resistance to bending in the vertical direction.

Figure 19:
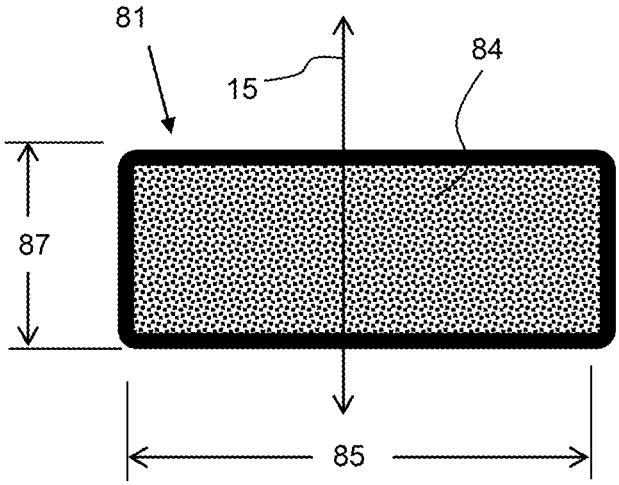
FIG. 19 shows an end view of plank lumber having a width extending horizontally or orthogonally with respect to the vertical axis.

As shown in FIG. 19, plank lumber 81 has a width 85 extending horizontally or orthogonally with respect to the vertical axis 15. The thickness 87 extends in the vertical direction and is much less than the width. The width may be about twice, three times, four times, five times or even six times the thickness, or any range between and including the ratios provided. The plank lumber may be a "2×4" 84, having a width that is about 3.5 inches and a thickness of about 1.5 inches.

Figure 20:
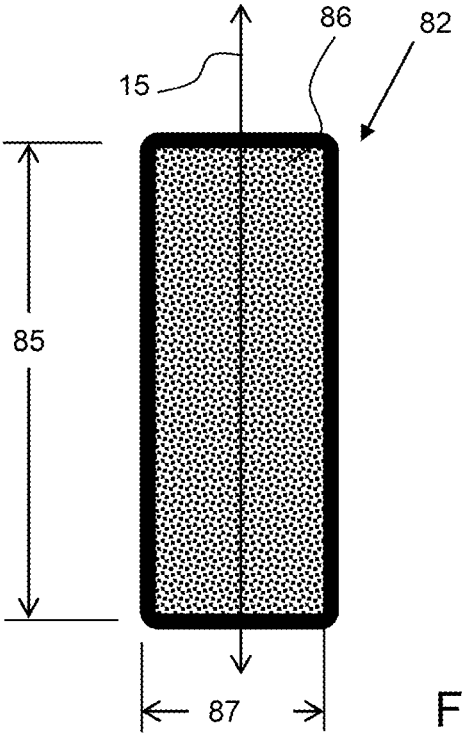
FIG. 20 shows an end view of support lumber having a width extending in the with respect to the vertical axis.

As shown in FIG. 20, support lumber 82 has a width 85 extending along the vertical axis 15. The thickness 87 extends in the horizontal direction or orthogonally to the vertical axis, and is much less than the width. The support lumber may be a "2×6" 86, having a width that is about 5.5 inches and a thickness of about 1.5 inches The support lumber and plank lumber may be wood, as described herein, or may be composite materials, including plastic, bonding materials and or wood components.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A dismantlable sawhorse comprising a sawhorse bracket assembly comprising:

a) a first sawhorse stand and a second sawhorse stand, each comprising a sawhorse bracket comprising:

i) an integral bracket plate that is a planar material having a height along a height axis, a width across a width axis of the bracket plate, said integral bracket plate comprising:

a bracket aperture that is a through hole through the bracket plate from an outside surface to an inside surface of the bracket plate comprising:

a plank aperture portion in the bracket plate having a plank width that extends across the width axis of the bracket plate;

a support aperture portion in the bracket plate having a support width that extends across the width axis of the bracket plate;

wherein the plank aperture is configured to receive plank lumber therethrough;

wherein the support aperture is configured to receive support lumber therethrough;

wherein the plank width is at least twice the support width; and wherein the plank aperture and the support aperture intersect with each other to form a continuous T-aperture or cross aperture having an opening with a continuous perimeter about said opening, and wherein the plank aperture and support aperture intersect to form an intersection space;

ii) a front leg cup and a back leg cup attached the bracket plate each forming a leg cup channel having leg lumber inserted therein;

wherein a rod support is configured in the intersection space of the first and second bracket plates and extends between the first and second bracket plates to form said dismantlable sawhorse.

2. The dismantlable sawhorse of claim 1, wherein the plank aperture is configured across a top of the continuous aperture.

3. The dismantlable sawhorse of claim 1, wherein each of the bracket plates further comprises a circular aperture.

4. The dismantlable sawhorse of claim 1, wherein the plank aperture width is orthogonal to the support aperture height.

5. A dismantlable sawhorse comprising a sawhorse bracket assembly comprising:

a) a first sawhorse stand and a second sawhorse stand, each comprising a sawhorse bracket comprising:

i) an integral bracket plate that is a planar material having a height along a height axis and a width across a width axis, said integral bracket plate comprising:

a bracket aperture that is a through hole through the bracket plate from an outside surface to an inside surface of the bracket plate comprising:

a plank aperture portion in the bracket plate having a plank width that extends across the width axis of the bracket;

wherein the plank aperture is configured to receive plank lumber therethrough;

a support aperture portion in the bracket plate having a support width that extends across the width axis-of the bracket plate;

wherein the support aperture is configured to receive support lumber therethrough; and wherein the plank aperture and the support aperture intersect with each other to form a continuous T-aperture or cross aperture having an opening with a continuous perimeter about said opening;

ii) a front leg cup and a back leg cup attached the bracket plate each forming a leg cup channel having leg lumber inserted therein;

wherein at least one of said plank lumber or said support lumber is configured in said plank aperture or said support aperture of the first and second bracket plate, respectively, and extends between the first and second bracket plates to form said dismantlable sawhorse; and wherein the plank width is at least twice the support width.

6. The dismantlable sawhorse of claim 5, wherein each of the bracket plates further comprises a circular aperture.

7. The dismantlable sawhorse of claim 6, wherein the circular aperture has circular aperture teeth configured along an inside of the circular aperture.

8. The dismantlable sawhorse of claim 5, wherein the plank aperture has a height of substantially 1.5 inch, wherein said height is 1.5 inch to 1.75 inch.

9. The dismantlable sawhorse of claim 8, wherein the support aperture has a height of substantially 3.5 inch, wherein said height is 3.5 inch to 3.75 inch.

10. The dismantlable sawhorse of claim 8, wherein the support aperture has a height of substantially 5.5 inch, wherein said height is 5.5 inch to 5.75 inch.

11. The dismantlable sawhorse of claim 8, wherein the plank aperture has plank aperture teeth configured along an inside of the plank aperture.

12. The dismantlable sawhorse of claim 8, wherein the support aperture has support aperture teeth configured along an inside of the support aperture.

13. The dismantlable sawhorse of claim 12, wherein the plank aperture has plank aperture teeth configured along an inside of the plank aperture.

14. The dismantlable sawhorse of claim 8, wherein the leg cup channel of the front leg cup and back leg cup extend at an offset angle of at least 20 degrees.

15. The dismantlable sawhorse of claim 14, wherein each of the leg cup channels have a width of substantially 3.5 inch.

16. The dismantlable sawhorse of claim 14, wherein each of the leg cup channels have a width of substantially 5.5 inch.

* * * * *